US011156938B2

(12) United States Patent
Sato

(10) Patent No.: US 11,156,938 B2
(45) Date of Patent: Oct. 26, 2021

(54) IMAGE FORMING APPARATUS INCLUDING A ROTARY BOTTLE FOR CONTAINING WASTE DEVELOPER

(71) Applicant: KYOCERA Document Solutions Inc., Osaka (JP)

(72) Inventor: Masaki Sato, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/194,425

(22) Filed: Mar. 8, 2021

(65) Prior Publication Data

US 2021/0286289 A1 Sep. 16, 2021

(30) Foreign Application Priority Data

Mar. 11, 2020 (JP) ..... JP2020-041904

(51) Int. Cl.
*G03G 21/10* (2006.01)
*G03G 15/08* (2006.01)

(52) U.S. Cl.
CPC ..... *G03G 15/0856* (2013.01); *G03G 21/10* (2013.01)

(58) Field of Classification Search
CPC ..... G03G 21/10; G03G 21/12
USPC ..... 399/35
See application file for complete search history.

(56) References Cited

U.S. PATENT DOCUMENTS

2014/0186063 A1* 7/2014 Hogan et al. ..... G03G 21/12 399/35
2021/0080895 A1* 3/2021 Nohara ..... G03G 21/12

FOREIGN PATENT DOCUMENTS

JP 2018-066789 4/2018

* cited by examiner

*Primary Examiner* — William J Royer
(74) *Attorney, Agent, or Firm* — Lex IP Meister, PLLC

(57) ABSTRACT

An image forming apparatus including: a printing unit; a bottle which is rotationally driven in a predetermined rotation direction, whereby a waste developer conveyed from the printing unit to an opening is accommodated inside and the waste developer inside is conveyed to a second end side in a longitudinal direction; and a capacitive sensor having a first detection electrode and a first ground electrode arranged in parallel, where a first detection surface of an electrostatic capacitance formed by the first detection electrode and the first ground electrode is arranged to directly face a portion of an outer peripheral surface of the bottle which is positioned obliquely upward with respect to a center line of rotation of the bottle in a region which moves from a bottom to a top when the bottle rotates in the predetermined rotation direction.

5 Claims, 7 Drawing Sheets

IMAGE FORMING APPARATUS INCLUDING A ROTARY BOTTLE FOR CONTAINING WASTE DEVELOPER

INCORPORATION BY REFERENCE

This application claims priority to Japanese Patent Application No. 2020-041904, filed Mar. 11, 2020, and incorporates the contents thereof.

The present disclosure relates to an image forming apparatus including a rotary bottle for containing waste developer.

BACKGROUND

Generally, an electrophotographic image forming apparatus includes a rotary bottle for containing a powdered waste developer collected from a printing apparatus for forming an image on a sheet. The bottle is a container having an opening formed at one end in a longitudinal direction. The bottle may be referred to as a waste toner bottle, for example.

The bottle has a helical convex portion which projects spirally along the longitudinal direction on an inner peripheral surface thereof. The bottle is disposed in a state in which the longitudinal direction is sideways and is rotationally driven. The rotating bottle accommodates the waste developer conveyed to the opening, and conveys the waste developer to the back of the bottle.

The image forming apparatus further includes a developer sensor for detecting an amount of the waste developer in the bottle. When the developer sensor detects that the amount of the waste developer in the bottle has reached the upper limit, the printing process by the printing apparatus is prohibited.

For example, it is known that the image forming apparatus includes a capacitive sensor for detecting the amount of the waste developer in the bottle, and the capacitive sensor includes two electrodes arranged to face each other via the bottle.

In some cases, the capacitive sensor has two electrodes arranged in parallel. Hereinafter, such capacitive sensor will be referred to as a parallel capacitive sensor. The two electrodes include a detection electrode and a ground electrode.

A cable connected to the parallel electrostatic capacitive sensor does not need to be wired across the bottle. Therefore, when the parallel capacitive sensor is employed, wiring is simplified.

On the other hand, when the bottle is rotating, the waste developer in the bottle repeatedly moves according to the movement of the inner peripheral surface of the bottle and then falls off. As a result, the upper surface of the waste developer in the bottle is maintained to be generally inclined at the repose angle of the waste developer.

Therefore, the waste developer is unevenly deposited on one side of the bottle. More specifically, the waste developer is unevenly deposited on one of the side surfaces of the bottle, which moves from the bottom to the top when the bottle rotates.

When the parallel capacitive sensor is arranged to face a portion of the bottle where the waste developer is concentrated, the capacitance detected by the parallel capacitive sensor may reach a measurement upper limit even though a sufficient amount of empty space remains in the bottle.

That is, there is a possibility that the parallel capacitive sensor cannot detect a change in the amount of the waste developer in the bottle even though the empty space in the bottle is large.

SUMMARY

An image forming apparatus according to one aspect of the present disclosure includes: a printing unit for performing a printing process for forming a toner image on a sheet and discharging a powdered waste developer; a bottle which is a container having an opening formed at a first end in a longitudinal direction, is disposed in a state in which the longitudinal direction is sideways, and is rotationally driven in a predetermined rotation direction, whereby the waste developer conveyed from the printing unit to the opening is accommodated inside and the waste developer inside is conveyed to a second end side in the longitudinal direction; and a capacitive sensor having a first detection electrode and a first ground electrode arranged in parallel, where a detection surface of an electrostatic capacitance formed by the first detection electrode and the first ground electrode is arranged to directly face a portion of an outer peripheral surface of the bottle which is positioned obliquely upward with respect to a center line of rotation of the bottle in a region which moves from a bottom to a top when the bottle rotates in the predetermined rotation direction.

An image forming apparatus according to another aspect of the present disclosure includes the printing apparatus, the bottle, and a capacitive sensor. The capacitive sensor has a first detection electrode and a first ground electrode arranged in parallel, where a detection surface of an electrostatic capacitance formed by the first detection electrode and the first ground electrode is arranged to directly face a portion of an outer peripheral surface of the bottle which is positioned at the same height as or obliquely upward with respect to a center line of rotation of the bottle in a region which moves from a top to a bottom when the bottle rotates in the predetermined rotation direction.

The objects, features, and advantages of the present disclosure will become more apparent from the following detailed description. Reference the detailed description, reference is made to the accompanying drawings in which preferred embodiments of the present disclosure are shown as examples.

DETAILED DESCRIPTION

Figure 1:
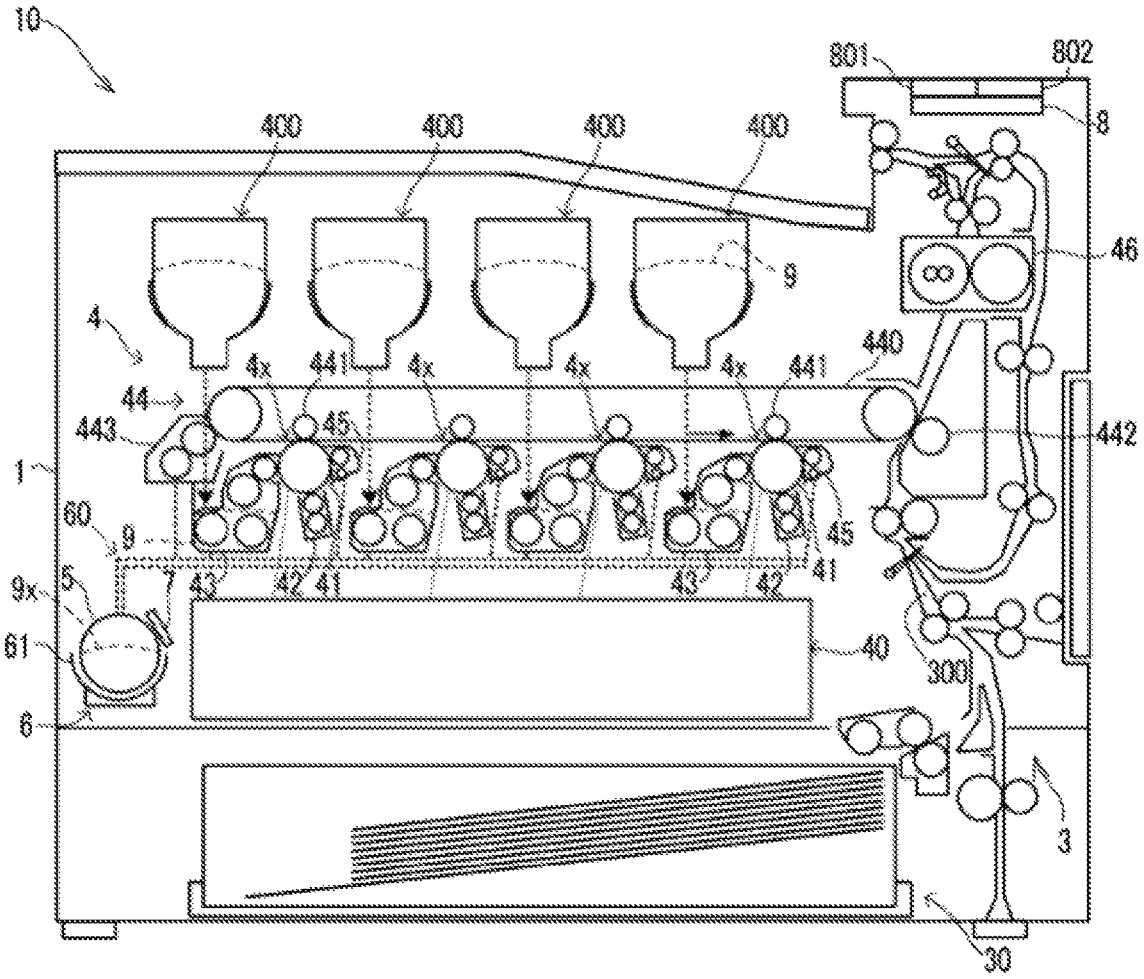
FIG. 1 is a block diagram of an image forming apparatus according to a first embodiment of the present invention.

Embodiments of the present disclosure will now be described with reference to the drawings. It should be noted that the following embodiment is an embodiment of the present disclosure and does not limit the technical scope of the present disclosure.

First Embodiment: Configuration of Image Forming Apparatus 10

An image forming apparatus 10 according to the first embodiment is an apparatus for forming an image on a sheet by an electrophotographic method. The sheet is a sheet-like image forming medium such as paper or a resin film.

The image forming apparatus 10 includes a sheet feeding unit 30, a sheet conveying unit 3, a printing unit 4, one or more toner containers 400, a bottle 5, and a waste developer collecting unit 6 disposed in a main body 1.

The sheet feeding unit 30 accommodates a plurality of sheets and feeds the accommodated sheets one by one to a sheet conveying path 300. The sheet conveying unit 3 conveys a sheet along the sheet conveying path 300.

The printing unit 4 executes printing processing for forming a toner image on the sheet supplied from the sheet feeding unit 30 through the sheet conveying unit 3 in an electrophotographic method.

The printing unit 4 includes a laser scanning unit 40, one or more image forming unit 4*x*, a transfer unit 44, and a fixing unit 46.

In the example shown in FIG. 1, the printing unit 4 is a tandem color image printing device. Therefore, the printing unit 4 includes four toner containers 400 and four image forming units 4*x* corresponding to four colors of toner. Each of the image forming units 4*x* includes a drum-shaped photosensitive member 41, a charging unit 42, a developing unit 43, and a drum cleaning unit 45.

In each of the image forming units 4*x*, the photosensitive member 41 rotates, and the charging unit 42 charges the outer peripheral surface of the photosensitive member 41. Further, in each of the image forming units 4*x*, the developing unit 43 develops the electrostatic latent image formed on the outer peripheral surface of the photosensitive member 41 by the laser scanning unit 40 into a toner image. The photosensitive member 41 is an example of an image carrier.

Further, the transfer unit 44 includes an intermediate transfer belt 440, four primary transfer units 441, a secondary transfer unit 442, and a belt cleaning unit 443.

The intermediate transfer belt 440 rotates while being in contact with the four photosensitive members 41, and the four primary transfer units 441 transfer the toner images from the four photosensitive members 41 to the intermediate transfer belt 440.

The secondary transfer unit 442 transfers the toner image on the intermediate transfer belt 440 onto the sheet being conveyed along the sheet conveying path 300. The belt cleaning unit 443 removes waste toner from the intermediate transfer belt 440. In each of the image forming units 4*x*, the drum cleaning unit 45 removes the waste toner remaining on the outer peripheral surface of the photosensitive member 41.

The fixing unit 46 fixes the toner image on the sheet by applying pressure while heating the toner image on the sheet. The sheet conveying unit 3 discharges the sheet on which the image has been formed from the sheet conveying path 300.

Each toner container 400 supplies toner 9 to a corresponding developing unit 43 in the printing unit 4.

In the printing unit 4, a developing unit 43 discharges a powdered waste developer 9*x* containing waste toner that has been retained for a long time. Further, the drum cleaning unit 45 and the belt cleaning unit 443 discharge the waste developer 9*x* as the removed material. The waste developer collecting unit 6 collects the waste developer 9*x* discharged from the printing unit 4 into the bottle 5.

Further, when the developing unit 43 performs development using a two-component developer containing a toner 9 and a carrier, the waste developer also contains a waste carrier which has stayed in the developing unit 43 for a long time. In some cases, the waste developer may contain the removed material by the drum cleaning unit 45 and the belt cleaning unit 443 and the waste carrier.

Figure 2:
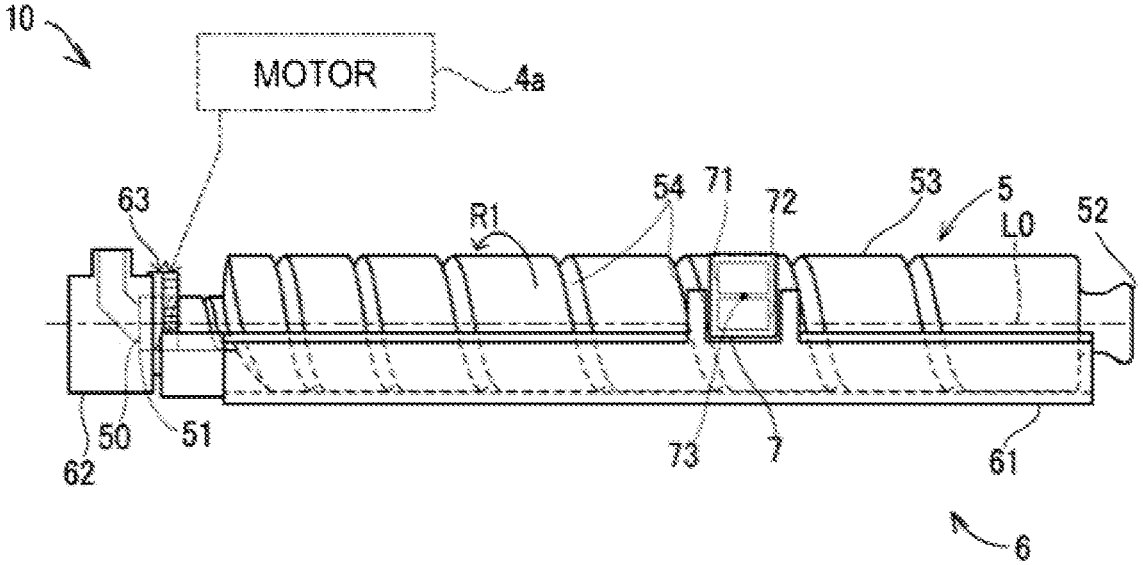
FIG. 2 is a block diagram showing a bottle and its peripheral portion in the image forming apparatus according to the first embodiment.

As shown in FIG. 2, the bottle 5 is a container having an opening 50 formed at a first end 51 in a longitudinal direction. For example, the bottle 5 is a container made of synthetic resin. The bottle 5 has a cylindrical outer peripheral surface 53.

The bottle 5 has a helical convex portion 54 projecting spirally along the longitudinal direction on the inner surface thereof. The helical convex portion 54 is a helical concave portion when viewed from the outside of the bottle 5.

The bottle 5 is disposed in a state in which the longitudinal direction is sideways and is rotationally driven. Thus, the bottle 5 accommodates the waste developer 9*x* conveyed from the developing unit 43 and the belt cleaning unit 443 to the opening 50, and conveys the waste developer 9*x* to a second end 52 side in the longitudinal direction. The center line of the outer peripheral surface 53 of the bottle 5 is the rotation center line L0 of the bottle 5.

The image forming apparatus 10 further includes a controller 8, an operation unit 801, and a display device 802. The operation unit 801 is a touch panel or an operation button for receiving a human operation. The display device 802 is a liquid crystal panel unit for displaying information.

Figure 3:
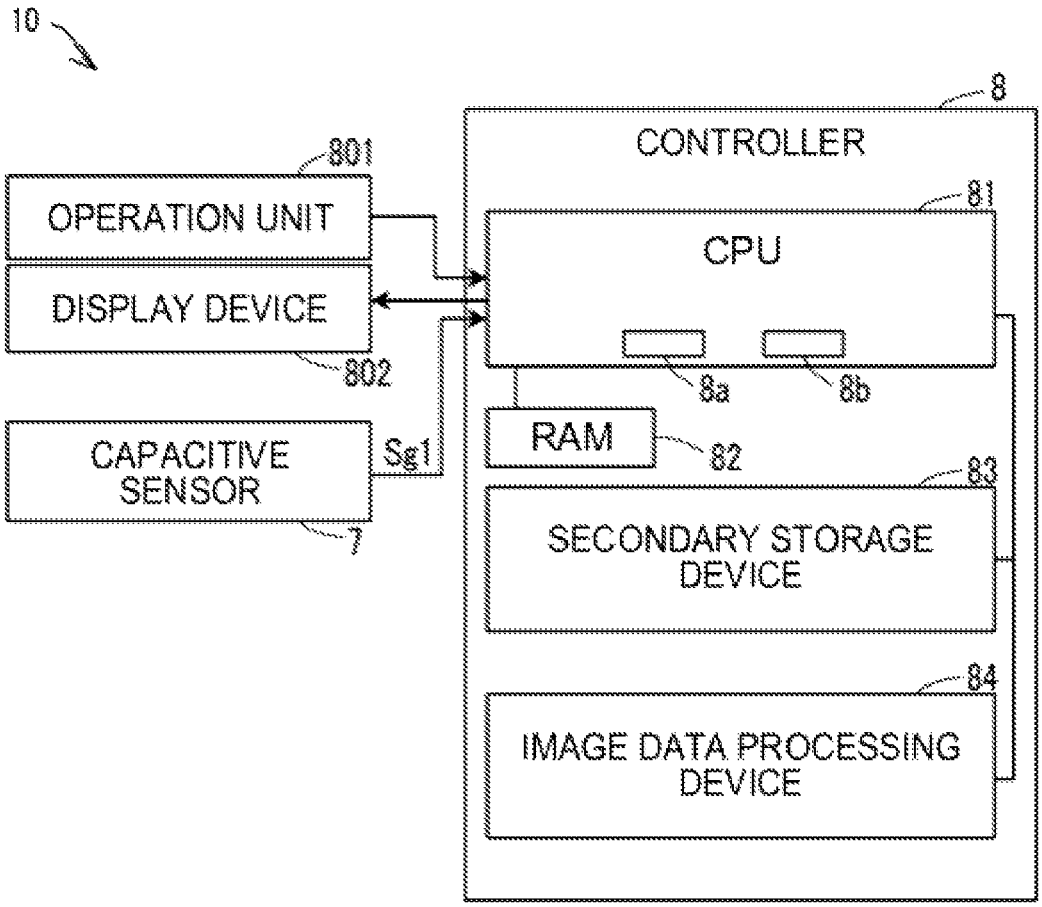
FIG. 3 is a block diagram showing a configuration of control-related equipment in the image forming apparatus according to the first embodiment.

As shown in FIG. 3, the controller 8 includes a central processing unit (CPU) 81, a random access memory (RAM) 82, a secondary storage device 83, an image data processing device 84, and the like.

The CPU 81 is an example of a processor that executes a program stored in the secondary storage device 83 or the like, to control electrical equipment in the image forming apparatus 10 and perform various kinds of data processing.

It is also conceivable that another processor such as a digital signal processor (DSP) executes various kinds of control and data processing in place of the CPU 81.

The RAM 82 is a storage device for primarily storing the program to be executed by the CPU 81 and data to be output and referenced in the process of executing the program by the CPU 81.

The secondary storage device 83 is a computer-readable nonvolatile data storage device. The secondary storage device 83 can store the program and various kinds of data. For example, one of or a combination of a hard disk drive and an SSD (Solid State Drive) is employed as the secondary storage device 83.

The image data processing device 84 executes image processing such as processing or conversion processing on the image data used in the printing processing. For example, the image data processing device 84 executes processing for converting print job data into raster data for printing.

For example, the image data processing device 84 may be implemented by one or both of a processor, such as a DSP, and an integrated circuit, such as an application specific integrated circuit (ASIC).

<Waste Developer Collecting Unit 6>

As shown in FIGS. 1 and 2, the waste developer collecting unit 6 includes a waste developer conveying mechanism 60, a bottle mounting portion 61, a carry-in relay portion 62, and a bottle driving mechanism 63.

The bottle mounting portion 61 supports a bottle 5 to accommodate the waste developer 9*x*. The bottle 5 is disposed on the bottle mounting portion 61 in a state in which the longitudinal direction is sideways. The waste developer conveying mechanism 60 conveys the waste developer 9*x* discharged from the developing unit 43 and the belt cleaning unit 443 to the carry-in relay portion 62.

The carry-in relay portion 62 is a member forming a guide duct 62*a*. The carry-in relay portion 62 guides the waste developer 9*x* conveyed into the guide duct 62*a* by the waste developer conveying mechanism 60 to the opening 50 of the bottle 5 supported by the bottle mounting portion 61.

The bottle driving mechanism 63 is connected to the first end 51 of the bottle 5 supported by the bottle mounting portion 61, and rotationally drives the bottle 5. A motor 4*a* for rotationally driving the photosensitive member 41 of the printing unit 4 also serves as a driving source for the waste developer conveying mechanism 60 and the bottle driving mechanism 63 (see FIG. 2).

The motor 4*a* is controlled by the controller 8 (see FIG. 2). In the present embodiment, the motor 4*a* and the bottle driving mechanism 63 are examples of driving devices for rotating the bottle 5.

The bottle driving mechanism 63 transmits the rotational force of the motor 4*a* to the first end 51 of the bottle 5. The bottle 5 receives power from the bottle driving mechanism 63 and rotates in a predetermined rotation direction R1.

By rotating the bottle 5 in the predetermined rotation direction R1, the waste developer 9*x* in the bottle 5 is leveled along the longitudinal direction of the bottle 5 while being transported to the second end 52 side. The rotation of the bottle 5 prevents the waste developer 9*x* from staying toward the opening 50 in the bottle 5.

The bottle 5 is removably mounted to the bottle mounting portion 61 and the bottle driving mechanism 63. When the amount of the waste developer 9*x* in the bottle 5 reaches the upper limit, the bottle 5 is replaced.

As shown in FIGS. 1 to 3, the image forming apparatus 10 further includes a capacitive sensor 7 disposed opposite to the outer peripheral surface 53 of the bottle 5. The capacitive sensor 7 detects the capacitance of the region in front of the capacitive sensor 7.

The capacitance detected by the capacitive sensor 7 increases with an increase in the amount of the waste developer 9*x* in the bottle 5. Therefore, the capacitance detected by the capacitive sensor 7 represents the amount of the waste developer 9*x* in the bottle 5.

In some cases, the capacitive sensor 7 has two electrodes arranged in parallel. Hereinafter, such a capacitive sensor will be referred to as a parallel capacitive sensor. The capacitive sensor 7 of the image forming apparatus 10 is the parallel capacitive sensor. Two electrodes of the capacitive sensor 7 include a detection electrode 71 and a ground electrode 72.

A cable connected to the parallel capacitive sensor 7 does not need to be wired across both sides of the bottle 5. Therefore, when the parallel capacitive sensor 7 is employed, the wiring is simplified.

On the other hand, when the bottle 5 is rotating, the waste developer 9*x* in the bottle 5 repeatedly moves according to the movement of the inner peripheral surface of the bottle 5 and then collapses. As a result, the upper surface of the waste developer 9*x* in the bottle 5 is maintained to be generally inclined at a repose angle of the waste developer 9*x* (see FIG. 4).

Therefore, the waste developer 9*x* is unevenly deposited on one side of the bottle 5. Specifically, the waste developer 9*x* is unevenly deposited on one of the side surfaces of the bottle 5, which moves from the bottom to the top when the bottle 5 rotates in the predetermined rotation direction R1 (see FIG. 4).

When the capacitive sensor 7 is disposed to face the portion of the bottle 5 where the waste developer 9*x* is concentrated, there is a possibility that the electrostatic capacitance detected by the capacitive sensor 7 reaches the measurement upper limit even though a sufficient amount of empty space remains in the bottle 5.

That is, there is a possibility that the capacitive sensor 7 cannot detect a change in the amount of the waste developer 9*x* in the bottle 5 even though the empty space in the bottle 5 is large.

On the other hand, the image forming apparatus 10 has a configuration which can prevent a case in which the capacitive sensor 7 cannot detect the change in the amount of the waste developer 9*x* in the bottle 5 even though the empty space in the bottle 5 is large. The configuration will be described below.

The capacitive sensor 7 has an electrostatic capacitance detection surface 70 formed by a detection electrode 71 and a ground electrode 72 arranged in parallel. The capacitive sensor 7 is an example of a first capacitive sensor. The detection electrode 71 and the ground electrode 72 are examples of the first detection electrode and the first ground electrode, respectively.

The capacitive sensor 7 is disposed closer to the second end 52 than the first end 51 in the longitudinal direction of the bottle 5 (see FIG. 2).

In the following description, a region of the outer peripheral surface 53 of the bottle 5 which moves from the bottom to the top when the bottle 5 rotates in the predetermined rotation direction R1 is referred to as a first outer peripheral region 53*a* (see FIG. 4). A region of the outer peripheral surface 53 of the bottle 5 which moves from the top to the bottom when the bottle 5 rotates in the predetermined rotation direction R1 is referred to as a second outer peripheral region 53*b* (see FIG. 4).

Figure 4:
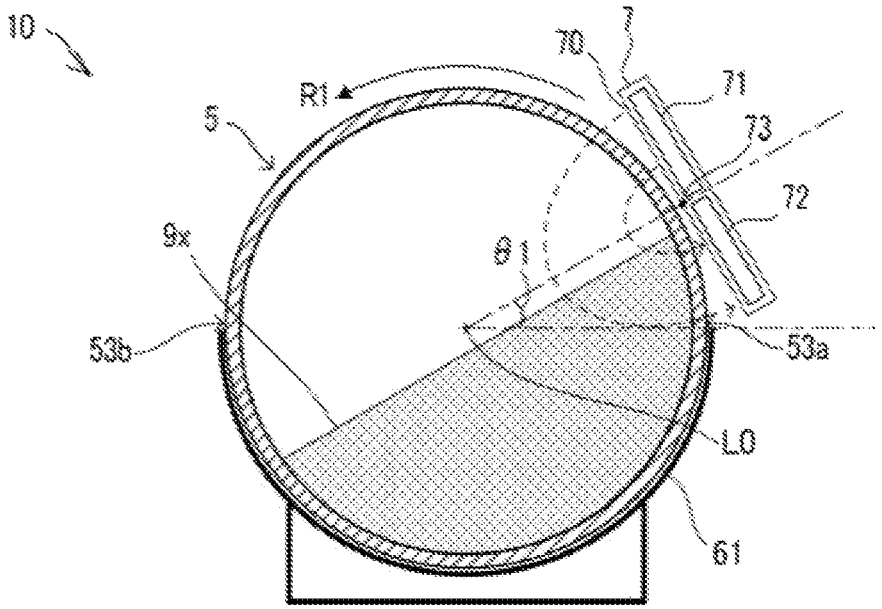
FIG. 4 is a view showing an arrangement position of a capacitive sensor in the image forming apparatus according to the first embodiment.

As shown in FIG. 4, the capacitive sensor 7 is disposed in a state in which the detection surface 70 of the capacitive sensor 7 directly faces a portion of the first outer peripheral region 53*a* of the bottle 5 that is positioned obliquely above the rotation center line L0 of the bottle 5.

In the present embodiment, the capacitive sensor 7 is arranged such that the detection electrode 71 and the ground electrode 72 are arranged in a vertical direction and the detection surface 70 is directed obliquely downward. In this case, the capacitive sensor 7 is arranged in such a state that an intermediate portion 73 between the detection electrode 71 and the ground electrode 72 on the detection surface 70 faces obliquely upward with respect to the rotation center line L0 of the bottle 5 in the first outer peripheral region 53*a* of the bottle 5.

Generally, the repose angle of the waste developer 9*x* is about 30 degrees. For this reason, it is preferable that the capacitive sensor 7 is arranged such that the elevation angle θ1 of viewing the intermediate portion 73 between the detection electrode 71 and the ground electrode 72 on the detection surface 70 from the rotation center line L0 is 15 to 30 degrees.

By arranging the capacitive sensor 7 as described above, it is possible to detect a change in which the waste developer 9*x* is unevenly deposited on the first outer peripheral region 53*a* side in the bottle 5 until the empty space in the bottle 5 becomes small.

<Processing of the CPU 81>

The CPU 81 of the controller 8 includes a state determination unit 8*a* and a device control unit 8*b* which are realized by executing a computer program stored in the secondary storage device 83 (see FIG. 3). The state determination unit 8*a* determines the state of the image forming apparatus 10 and notifies the determination result.

The device control unit 8*b* controls various devices including the printing unit 4 in the image forming apparatus 10. For example, the device control unit 8*b* indirectly controls the waste developer conveying mechanism 60 and the bottle driving mechanism 63 by controlling the printing unit 4.

The device control unit 8*b* operates the waste developer conveying mechanism 60 and the bottle driving mechanism 63 by operating the motor 4*a* of the printing unit 4 when predetermined operating conditions are satisfied.

Specifically, the operating condition is a condition established between the start and the end of the printing process. That is, the operating conditions of the waste developer conveying mechanism 60 and the bottle driving mechanism 63 in the present embodiment are conditions under which the printing unit 4 executes the printing process.

For example, the operating conditions are established from the generation of the print job as the execution request of the printing process to the completion of the printing process corresponding to the print job.

However, the device control unit 8*b* prohibits the printing unit 4 from performing the printing process when the state determination unit 8*a* determines a full state to be described later. The full state is a state in which the amount of the waste developer 9*x* in the bottle 5 has reached a predetermined upper limit.

The state determination unit 8*a* determines that the full state has occurred when the level of a detection signal Sg1 of the capacitive sensor 7 is out of the predetermined allowable range. When the level of the detection signal Sg1 is within the allowable range, the state determination unit 8*a* determines the amount of the waste developer 9*x* in the bottle 5 based on the level of the detection signal Sg1.

Further, the state determination unit 8*a* notifies the determination result through the display device 802. For example, when determining that the full state has occurred, the state determination unit 8*a* notifies that the bottle 5 needs to be replaced. The state determination unit 8*a* causes the display device 802 to display the determination result of the amount of the waste developer 9*x* in the bottle 5.

Second Embodiment

Next, the image forming apparatus 10A according to a second embodiment will be described with reference to FIGS. 5 and 6. an image forming apparatus 10A has a configuration in which another capacitive sensor 7*x* is added to the image forming apparatus 10.

The capacitive sensor 7*x* is a parallel capacitive sensor which has a detection electrode 71*x* and a ground electrode 72*x* arranged in parallel, just as the capacitive sensor 7. The capacitive sensor 7*x* has a detection surface 70*x* of capacitance formed by the detection electrode 71*x* and the ground electrode 72*x* arranged in parallel (see FIG. 6).

The capacitive sensor 7*x* is an example of a second capacitive sensor. The detection electrode 71*x* and the ground electrode 72*x* are examples of a second detection electrode and a second ground electrode, respectively.

Figure 6:
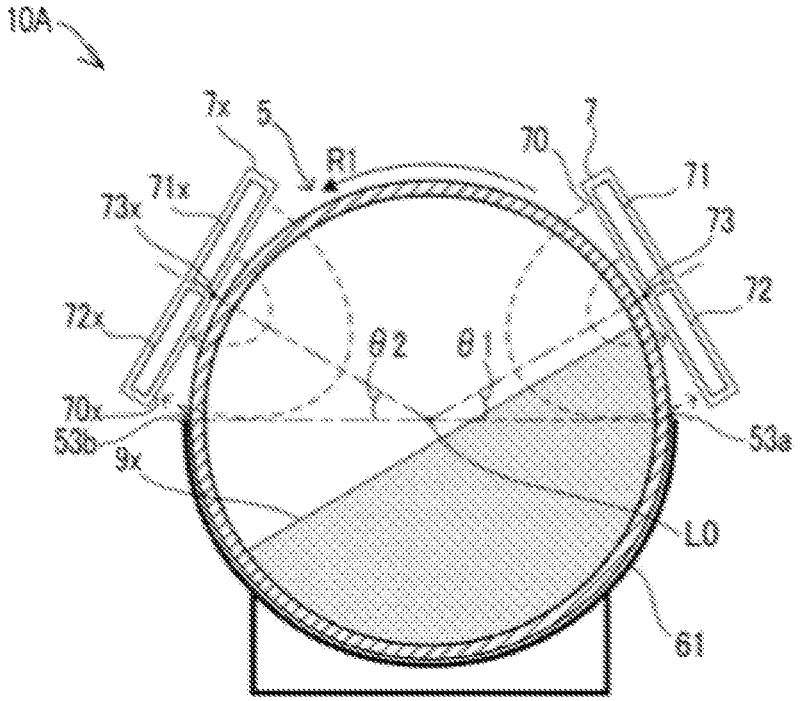
FIG. 6 is a view showing the arrangement positions of two capacitive sensors in the image forming apparatus according to the second embodiment.

The capacitive sensor 7*x* is disposed such that its detection surface 70*x* directly faces a portion of the second outer peripheral region 53*b* of the bottle 5 which is positioned obliquely upward with respect to the rotation center line L0 of the bottle 5 (see FIG. 6).

The capacitive sensor 7*x* is arranged such that the detection electrode 71*x* and the ground electrode 72*x* are arranged vertically and the detection surface 70*x* faces obliquely downward.

For example, it is conceivable that the capacitive sensor 7*x* is arranged such that an elevation angle θ2 at which an intermediate portion 73*x* between the detection electrode 71*x* and the ground electrode 72*x* on a detection surface 70*x* is viewed from the rotation center line L0 is 15 to 30 degrees.

In the present embodiment, the capacitive sensor 7 can detect a change in the amount of the waste developer 9*x* with high sensitivity under a situation where the amount of the waste developer 9*x* in the bottle 5 is relatively small. On the other hand, the capacitive sensor 7*x* can detect a change in the amount of the waste developer 9*x* with high sensitivity under a situation where the amount of the waste developer 9*x* in the bottle 5 is relatively large.

In the present embodiment, when the detection amount of the capacitive sensor 7 is lower than a predetermined reference electrostatic capacitance, the state determination unit 8*a* determines the amount of the waste developer 9*x* in the bottle 5 based on the detection amount of the capacitive sensor 7. When the amount detected by the capacitive sensor 7 exceeds the reference electrostatic capacitance, the state determination unit 8*a* determines the amount of the waste developer 9*x* in the bottle 5 based on the amount detected by the capacitive sensor 7*x*.

Specifically, a first relational data and a second relational data are stored in the secondary storage device 83 in advance. The first relational data is data representing a correspondence relationship between a detection amount of the capacitive sensor 7 in a predetermined range from a predetermined first minimum electrostatic capacitance to a predetermined first maximum electrostatic capacitance and an amount of the waste developer 9*x* in a predetermined range from a predetermined minimum waste developer amount to a predetermined intermediate waste developer amount. The first maximum electrostatic capacitance corresponds to the reference electrostatic capacitance.

The second relational data is data representing a correspondence relationship between the detection amount of the capacitive sensor 7*x* in a range from a predetermined second minimum electrostatic capacitance to a predetermined second maximum electrostatic capacitance and the amount of the waste developer 9*x* in a range from a intermediate waste developer amount to a predetermined maximum waste developer amount.

When the amount detected by the capacitive sensor 7 is less than the reference electrostatic capacitance, the state determination unit 8*a* converts the amount detected by the capacitive sensor 7 into the amount of the waste developer 9*x* based on the first relational data. When the amount detected by the capacitive sensor 7 exceeds the reference electrostatic capacitance, the state determination unit 8*a* converts the amount detected by the capacitive sensor 7*x* into the amount of the waste developer 9*x* based on the second relational data.

By adopting the image forming apparatus 10A, the state determination unit 8*a* can detect a change in the amount of the waste developer 9*x* with high sensitivity in a wide range of situations ranging from a situation where the amount of the waste developer 9*x* in the bottle 5 is small to a situation where the amount of the waste developer 9*x* in the bottle 5 is large.

Figure 5:
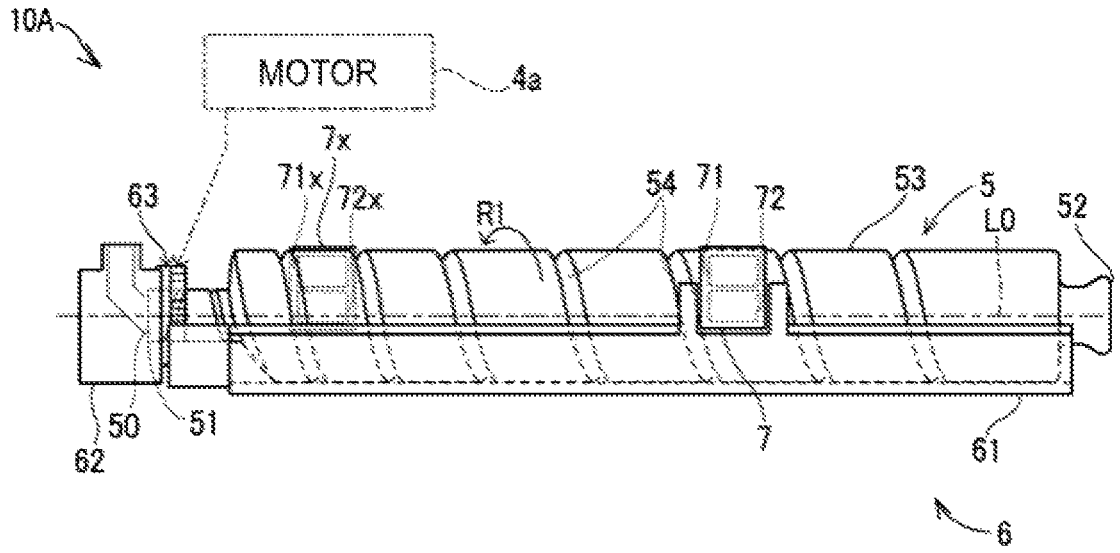
FIG. 5 is the block diagram of a bottle and its peripheral portion in the image forming apparatus according to a second embodiment.

In the present embodiment, the capacitive sensor 7*x* is disposed on the first end 51 side of the bottle 5, with respect to the capacitive sensor 7 (see FIG. 5).

The bottle 5 rotates to transport the waste developer 9*x* towards the second end 52. Therefore, the portion of the bottle 5 closer to the first end 51 becomes full later than the portion closer to the second end 52. Therefore, since the capacitive sensor 7*x* is disposed near the first end 51 of the bottle 5, the state determination unit 8*a* can detect a change in the amount of the waste developer 9*x* with high sensitivity until the bottle 5 becomes full.

Third Embodiment

Next, an image forming apparatus 10B according to a third embodiment will be described with reference to FIG. 7. The image forming apparatus 10B has a configuration in which the capacitive sensor 7 of the image forming apparatus 10 is replaced with a capacitive sensor 7*y*.

The capacitive sensor 7*y* is a parallel capacitive sensor having a detection electrode 71*y* and a ground electrode 72*y* arranged in parallel, just as the capacitive sensor 7. The capacitive sensor 7*y* has a capacitance detection surface 70*y* formed by the detection electrode 71*y* and the ground electrode 72*y* arranged in parallel (see FIG. 7).

The capacitive sensor 7*y* is arranged such that the detection electrode 71*y* and the ground electrode 72*y* are arranged vertically and the detection surface 70*y* is oriented horizontally or obliquely downward.

The capacitive sensor 7*y* is disposed such that its detection surface 70*y* directly faces a portion of the second outer peripheral region 53*b* of the outer peripheral surface 53 of the bottle 5 which is positioned at the same height as or obliquely above the rotation center line L0 of the bottle 5.

Figure 7:
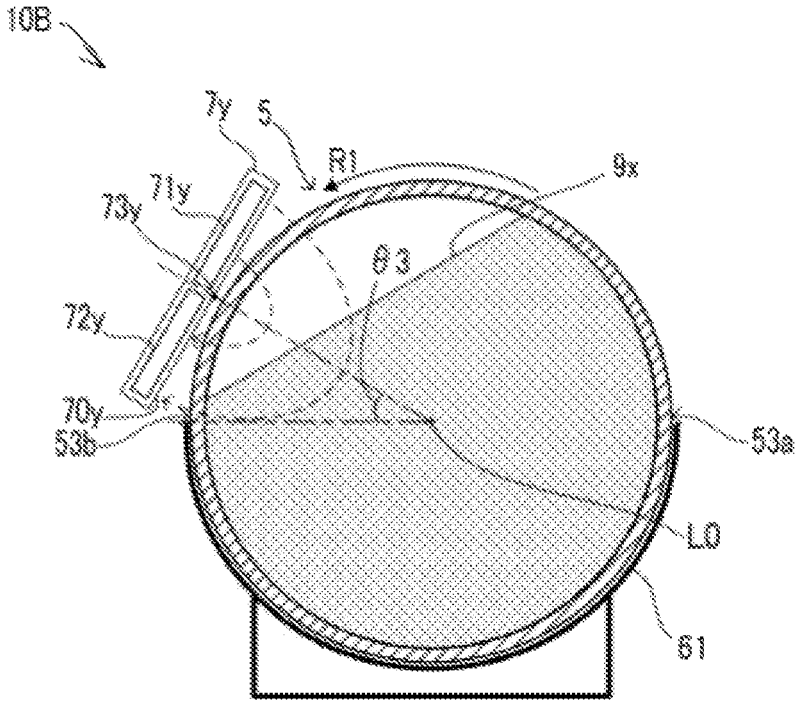
FIG. 7 is a view showing an arrangement position of the capacitive sensor in the image forming apparatus according to the third embodiment.

In the example shown in FIG. 7, the capacitive sensor 7*y* is arranged in such a state that the detection surface 70*y* thereof directly faces a portion of the second outer peripheral region 53*b* which is positioned obliquely upward with respect to the rotation center line L0 of the bottle 5.

For example, it is conceivable that the capacitive sensor 7*y* is arranged such that an elevation angle θ3 of viewing the intermediate portion 73*y* between the detection electrode 71*y* and the ground electrode 72*y* on the detection surface 70*y* from the rotation center line L0 is 15 to 30 degrees.

With the use of the image forming apparatus 10B, the state determination unit 8*a* can detect a change in the amount of the waste developer 9*x* with high sensitivity under a situation where the amount of the waste developer 9*x* in the bottle 5 is relatively large.

It should be noted that the description of the one aspect of the image forming apparatus according to the present disclosure, and the technical scope of the present disclosure is not limited to the above embodiment. The present disclosure may be variously changed, replaced, and modified without departing from the spirit of the technical idea, and the claims include all embodiments that can be included in the scope of the technical idea.

What is claimed is:

1. An image forming apparatus comprising:

a printing unit for performing a printing process for forming a toner image on a sheet and discharging a powdered waste developer;

a bottle which is a container having an opening formed at a first end in a longitudinal direction, is disposed in a state in which the longitudinal direction is sideways, and is rotationally driven in a predetermined rotation direction, whereby the waste developer conveyed from the printing unit to the opening is accommodated inside and the waste developer inside is conveyed to a second end side in the longitudinal direction; and a first capacitive sensor having a first detection electrode and a first ground electrode arranged in parallel, where a first detection surface of an electrostatic capacitance formed by the first detection electrode and the first ground electrode is arranged to directly face a portion of an outer peripheral surface of the bottle which is positioned obliquely upward with respect to a center line of rotation of the bottle in a region which moves from a bottom to a top when the bottle rotates in the predetermined rotation direction.

2. The image forming apparatus according to claim 1, further comprising a second capacitive sensor having a second detection electrode and a second ground electrode arranged in parallel, where a second detection surface of an electrostatic capacitance formed by the second detection electrode and the second ground electrode is arranged to directly face a portion of the outer peripheral surface of the bottle which is positioned obliquely upward with respect to the center line of rotation of the bottle in a region which moves from the top to the bottom when the bottle rotates in the predetermined rotation direction.

3. The image forming apparatus according to claim 2, wherein the second capacitive sensor is disposed on the first end side of the bottle, with respect to the first capacitive sensor.

4. The image forming apparatus according to claim 2, further comprising a state determination unit which determines an amount of the waste developer in the bottle based on a detection amount of the first capacitive sensor when a detection amount of the first capacitive sensor is lower than a predetermined reference electrostatic capacitance, and determines the amount of the waste developer in the bottle based on a detection amount of the second capacitive sensor when the detection amount of the first capacitive sensor is higher than the reference electrostatic capacitance.

5. An image forming apparatus comprising:

a printing unit for performing a printing process for forming a toner image on a sheet and discharging a powdered waste developer;

a bottle which is a container having an opening formed at a first end in a longitudinal direction, is disposed in a state in which the longitudinal direction is sideways, and is rotationally driven in a predetermined rotation direction, whereby the waste developer conveyed from the printing unit to the opening is accommodated inside and the waste developer inside is conveyed to a second end side in the longitudinal direction; and a capacitive sensor having a first detection electrode and a first ground electrode arranged in parallel, where a detection surface of an electrostatic capacitance formed by the first detection electrode and the first ground electrode is arranged to directly face a portion of an outer peripheral surface of the bottle which is positioned at the same height as or obliquely upward with respect to a center line of rotation of the bottle in a region which moves from a top to a bottom when the bottle rotates in the predetermined rotation direction.

* * * * *